US005712222A

United States Patent [19]

Shirai et al.

[11] Patent Number: 5,712,222

[45] Date of Patent: Jan. 27, 1998

[54] THERMAL TRANSFER IMAGE-RECEIVING SHEET

[75] Inventors: Koichi Shirai; Kazunobu Imoto, both of Tokyo-To, Japan

[73] Assignee: Dai Nippon Printing Co., Ltd., Japan

[21] Appl. No.: 554,587

[22] Filed: Nov. 6, 1995

[30] Foreign Application Priority Data

Nov. 4, 1994 [JP] Japan ..... 6-295770

[51] Int. Cl.[6] ..... B41M 5/035; B41M 5/38

[52] U.S. Cl. ..... 503/227; 428/195; 428/409; 428/913; 428/914

[58] Field of Search ..... 8/471; 428/195, 428/409, 913, 914; 503/227

[56] References Cited

U.S. PATENT DOCUMENTS 5,093,306 3/1992 Mukoyoshi et al. ..... 503/227

5,266,550 11/1993 Asajima et al. ..... 503/227

5,300,398 4/1994 Kaszczuk ..... 430/200

FOREIGN PATENT DOCUMENTS 0529537 3/1993 European Pat. Off. ..... 503/227

*Primary Examiner*—Bruce H. Hess

*Attorney, Agent, or Firm*—Parkhurst, Wendel & Burr,L.L.P.

[57] ABSTRACT

A thermal transfer image-receiving sheet including a substrate, a receptive layer and a gloss control layer provided between the substrate and the receptive layer. The gloss control layer has a surface roughness of 0.07 to 2.00 μm as measured according to ISO 4287/1. A method of controlling the gloss of a thermal transfer image-receiving sheet including a substrate and a receptive layer includes providing a gloss control layer between the substrate and the receptive layer and controlling the surface roughness of the gloss control layer, as measured according to ISO 4287/1, in the range of 0.07 to 2.00 μm thereby to control the glossiness of the surface on the receptive layer side in the range of 10 to 95% as measured according to JIS Z8741 Method 4.

7 Claims, 2 Drawing Sheets

THERMAL TRANSFER IMAGE-RECEIVING SHEET

BACKGROUND OF THE INVENTION

1. Field of the Art

The present invention relates to a thermal transfer image-receiving sheet for use in a sublimation thermal transfer recording system, and more particularly to a thermal transfer image-receiving sheet having a particular gloss control layer by virtue of which the image-receiving surface has a desirably controlled gloss.

2. Background Art

Various thermal transfer recording systems are known in the art, and one of them is a sublimation transfer recording system in which a sublimable dye as a colorant is transferred from a thermal transfer sheet to an image-receiving sheet by means of a thermal head capable of generating heat in response to recording signals, thereby forming an image. In this recording system, since a dye is used as the colorant and gradation of the density is possible, a very sharp image can be formed and, at the same time, the color reproduction and tone reproduction of half tone are excellent, making it possible to form an image having a quality comparable to that formed by silver salt photography.

By virtue of the above excellent performance and the development of various hardwares and softwares associated with multi-media, the sublimation transfer recording system has rapidly increased the market in a full-color hard copy system for computer graphics, static images through satellite communication, digital images represented by CDROM, and analog images such as video.

Specific applications of the image-receiving sheet in the dye sublimation transfer recording system are various, and representative examples thereof include proof printing, output of an image, output of a design, such as CAD/CAM, output applications for various medical instruments for analysis, such as CT scan, output applications for measuring equipment, alternatives for instant photography, output of photograph of a face to identification (ID) cards, credit cards, and other cards, and applications in composite photographs and pictures for keepsake in amusement facilities, such as pleasure grounds, museums, aquariums, and the like.

The thermal transfer image-receiving sheet for sublimation transfer used in the above various applications (hereinafter referred to simply as "thermal transfer image-receiving sheet" or "image-receiving sheet") generally comprises a substrate and a color-receptive layer formed thereon. It is needless to say that high sensitivity in printing and good stability against curling associated with printing are required of the image-receiving sheet. Further, the diversification of applications of the image-receiving sheet has expanded the market and has led to an ever-increasing demand for color reproduction in halftone, a sharp image free from an uneven density, and feeling such as glossiness suited for contemplated applications.

For example, a high glossiness such as attained by silver salt photography is required in some applications, while unglossy (matte) feeling such as seen in a matte coat paper is required in other applications.

The following methods have hitherto been used for controlling the gloss of the surface of the image-receiving sheet.

For example, Japanese Patent Laid-Open No. 122991/1990 describes a method for imparting a gloss, wherein a plastic film is put on the surface of a receptive layer and hot lamination is carried out by heating under pressure. According to this method, a gloss is imparted by improving the smoothness of the surface per se of the receptive layer. This method, however, necessitates providing additional steps and, further, preparing a plastic film, resulting in remarkably increased production cost.

On the other hand, Japanese Patent Laid-Open No. 115993/1992 discloses a method for imparting matte feeling, wherein an inorganic filler is incorporated in a colorant-receptive layer. In an image-receiving sheet prepared by this method, however, an inorganic filler is unavoidably present on the surface of the colorant-receptive layer, resulting in the formation of a printed image having a rough surface, an uneven density, and a dropout.

Japanese Patent Laid-Open No. 142991/1992 discloses a method wherein the surface of a colorant-receptive layer is embossed. Here again, irregularities are present on the surface of the colorant-receptive layer in the image-receiving sheet prepared by this method. Therefore, this image-receiving sheet also suffers from the formation of a printed image having a rough surface, an uneven density, and a dropout.

Accordingly, an object of the present invention is to provide a thermal transfer image-receiving sheet having a desirably controlled gloss suitable for contemplated applications and free from drawbacks of the prior art, i.e., an uneven density and a dropout in a printed image.

SUMMARY OF THE INVENTION

It has been found that the above object can be attained by providing a particular gloss control layer between a substrate and a receptive layer in a thermal transfer image-receiving sheet.

Thus, according to a first aspect of the present invention, there is provided a thermal transfer image-receiving sheet comprising: a substrate; a receptive layer; and a gloss control layer provided between the substrate and the receptive layer, the gloss control layer having a surface roughness of 0.07 to 2.00 μm as measured according to ISO 4287/1.

According to a second aspect of the present invention, there is provided a method of controlling the gloss of a thermal transfer image-receiving sheet comprising a substrate and a receptive layer, which comprises providing a gloss control layer between the substrate and the receptive layer and controlling the surface roughness of the gloss control layer, as measured according to ISO 4287/1, in the range of 0.07 to 2.00 μm thereby to control the glossiness of the surface on the receptive layer side in the range of 10 to 95% as measured according to JIS Z8741 Method 4.

According to the present invention, the gloss of the surface of the receptive layer in the image-receiving sheet is controlled by controlling the surface roughness of the particular layer provided as an intermediate layer between the substrate and the receptive layer. Therefore, according to the present invention, the glossiness of the image-receiving surface can be controlled in a wide range as desired without sacrificing the quality of a printed image, i.e., without causing an uneven density and a dropout in a printed image.

Figure 1:
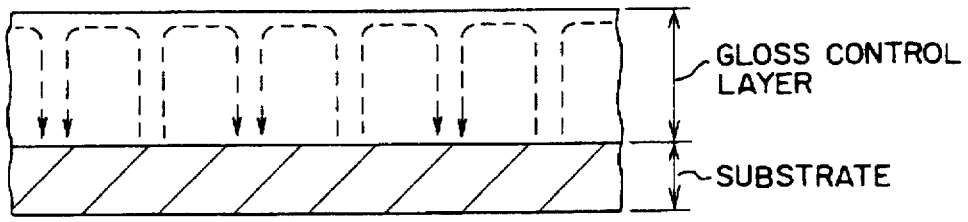
FIG. 1 is a typical diagram showing the convection of an ink in the course of the formation of a gloss control layer (at the time of drying of an ink after coating on the substrate)

In the drawings, numeral 1 denotes a plastic film, numeral 2 a support, numeral 3 an anticurl layer, numeral 4 a gloss control layer, numeral 5 a receptive layer, numeral 11 a core layer, numeral 12 an opaque layer, and numeral 13 a surface skin layer.

DETAILED DESCRIPTION OF THE INVENTION

Substrate

Conventional plastic films, synthetic papers, papers, and other materials may be used as the substrate. Among them, plastic films and synthetic papers having microvoids in their interior are preferred. The use of a substrate having microvoids in its interior can provide an image-receiving sheet having a high sensitivity in printing.

Preferably, the substrate per se has a glossiness of not less than 80% as measured according to JIS Z8741 Method 4. When the glossiness is less than 80%, it becomes difficult to control the glossiness of the surface on the receptive layer side of the image-receiving sheet in a high glossiness of not less than 80%.

The plastic film is preferably one formed by extruding and stretching a resin composed mainly of polyethylene terephthalate (PET) or a polyolefin. A film composed mainly of polypropylene having high flexibility, cushioning property, and heat insulation is still preferred.

There are two methods for forming microvoids in the plastic film. One of them is to carry out suitable biaxial stretching upon the preparation of a film by mixing and kneading a polymer with inorganic fine particles and then extruding the mixture (compound) into a film. Upon the stretching, the inorganic fine particles serve as a nucleus to form microvoids in the film.

The other method for forming microvoids is to carry out suitable biaxial stretching in the preparation of a film by blending a resin as a main component with at least one polymer immiscible with the resin and extruding the resultant compound into a film. The microscopic observation of this compound reveals that the polymers constitute a fine islands-sea structure. Stretching of the film causes cleavage at the interface of the islands-sea structure or large deformation of the polymer constituting the islands, leading to the formation of microvoids.

When the above two methods are compared, the latter method is better suited for the present invention. This is because, according to the latter method, the islands-sea structure in the compound can be made very fine simply by an adequate mixing and kneading, resulting in the formation of very fine voids by stretching. The presence of smaller microvoids in a larger number can provide superior cushioning properties and heat insulating properties to the plastic film, thus providing higher sensitivity in printing to the resulting image-receiving sheet.

A material composed mainly of polypropylene and, added thereto, a polyester and isoprene is preferred as a material for constituting a layer having microvoids. When the layer having microvoids is formed by the latter method, the use of a blend of polypropylene with a polyester is known in the art. In this case, the polyester serves as a foaming agent. However, it is difficult to create satisfactorily fine and dense microvoids by using these two materials alone. The addition of isoprene results in the creation of finer and denser microvoids and higher sensitivity in printing. If necessary, minor amounts of additives, such as inorganic pigments and fluorescent brightening agent, may be added.

When the layer having microvoids has a single layer structure of a plastic film or a synthetic paper, the opaqueness is often poor although the sensitivity in printing is high. In this case, it is possible to use a plastic film comprising the above layer having microvoids as a core layer and an opaque layer provided on one side or both sides of the core. The opaque layer is preferably formed of a dispersion of a white pigment in a binder polymer composed mainly of polypropylene which is the same polymer as used in the layer having microvoids.

White pigments usable herein include calcium carbonate, talc, kaolin, titanium oxide, zinc oxide, and other known inorganic pigments with $TiO_2$ being generally preferred from the viewpoint of the opaqueness-imparting property and the whiteness. The thickness of the opaque layer is preferably 1 to 10 μm. When it is less than 1 μm, the opaqueness-imparting property is very unsatisfactory, while when it exceeds 10 μm, the sensitivity in printing is lowered.

When the plastic film comprises a core layer having microvoids and an opaqueness layer, high sensitivity in printing and opaqueness can be imparted. In some cases, however, a gloss such as attained by silver salt photography cannot be provided. Further, surface irregularities attributable to an inorganic pigment present in the opaque layer and, in the absence of the opaque layer, irregularities attributable to the core layer often cause dropout and uneven density. A plastic film having the above layer construction with a surface skin layer being additionally provided thereon may be used in order to solve such a problem and impart a high gloss.

The skin layer is preferably formed of a polyolefin resin, particularly polypropylene as used in the core layer and the opaque layer from the viewpoints of easiness of formation and adhesion to the opaqueness layer. The surface skin layer is substantially free from microvoids and an inorganic pigment. The thickness of the surface skin layer is preferably 1 to 10 μm. When it is less than 1 μm, the gloss is unsatisfactory. On the other hand, a thickness exceeding 10 μm adversely affects the sensitivity in printing as in the case of the opaque layer.

When the substrate of the image-receiving sheet is consists of the above plastic film alone, curling is likely to occur due to heat applied during printing. In such a case, various supports may be laminated to prevent curling.

Various types of paper composed mainly of a cellulosic fiber, such as coat paper, art paper, glassine paper, cast coat paper, wood free paper, kraft paper, and paper impregnated with a resin, and a PET film composed mainly of polyethylene terephthalate may be used as the support for lamination onto the plastic film. In particular, when the image-receiving sheet should be smooth and when dimensional stability against moisture is strongly required, the use of a PET film is preferred. A white PET film can impart higher opaqueness.

The support can be laminated onto the plastic film by known methods such as dry lamination and EC lamination.

Mere lamination of the support onto the plastic film is, in some cases, still unsatisfactory in the prevention of curling associated with printing and curling associated with a change in environment. In this case, it is preferred to provide an anticurl layer onto the support on its side remote from the plastic film.

The provision of a plastic resin layer as the anticurl layer is preferred. The plastic resin layer is formed of preferably a polyolefin resin, still preferably a polyethylene resin which is a blend of a low-density polyethylene with a high-density polyethylene. The sole use of the low-density polyethylene results in deteriorated heat resistance. On the other hand, the sole use of the high-density polyethylene is unrealistic from the viewpoint of a problem of suitability for the formation of a layer. The ratio of the low-density polyethylene to the high-density polyethylene is preferably in the range of from about 30:1 to 5:5.

Preferably, the anticurl layer is formed by extrusion coating. The thickness thereof is preferably 30 to 130% of the thickness of the plastic film. When it is less than 30%, no satisfactory anticurling performance can be attained. On the other hand, a thickness exceeding 130% results in mere increase in the thickness of the image-receiving sheet, and the anticurling performance is saturated and substantially the same as that attained in the case of a thickness of not more than 130%, or curling occurs in a direction opposite to that in the case of a thickness of less than 30%.

The anticurl layer may be formed by laminating the same plastic film as formed in the provision of the colorant-receptive layer.

Further, a slipperiness-imparting layer may be provided on the anticurl layer. The slipperiness-imparting layer may be formed of a blend of a resin with various additives such as a filler or silicone.

The thickness of the above plastic film is preferably 35 to 80 μm. When it is less than 35 μm, the foam layer having voids becomes substantially thin, resulting in lowered sensitivity in printing. Further, in this case, uneven density is likely to occur due to the influence of very small irregularities on the support which will be described later. On the other hand, when the thickness exceeds 80 μm, the whole thickness of the image-receiving sheet including the support becomes large, adversely affecting the carriability of the image-receiving sheet in a printer.

Gloss Control Layer

A mixture of a filler with a binder is preferred as a material for the gloss control layer. The filler may be a conventional organic or inorganic filler. It is preferably a white inorganic pigment from the viewpoint of the whiteness and opaqueness required of image-receiving paper with titanium oxide being particularly preferred. The primary particle diameter of the filler is preferably 0.2 to 0.3 μm from the viewpoint of various optical properties. When it is not more than 0.2 μm, a problem such as agglomeration makes it difficult to form the gloss control layer. On the other hand, a primary particle diameter exceeding 0.3 μm causes an increase in scattering coefficient resulting in deteriorated optical properties and, at the same time, makes it difficult to control the gloss of the image-receiving sheet on a high level.

The binder may be any conventional thermoplastic resin, and examples thereof include polyester, polyurethane, polycarbohate, polyolefin, polyvinyl chloride, and polyvinyl acetate and various copolymers and polymer blends.

If necessary, various additives, such as curing agents, fluorescent brightening agents, and plasticizers, may be added to a mixture of the filler with the binder.

The thickness of the gloss control layer formed of the above material is preferably 1.0 to 10 μm. When it is less than 1.0 μm, no satisfactory matte feeling can be provided if the substrate per se has a high gloss. On the other hand, a thickness exceeding 10 μm adversely affects the cushioning property of the substrate, often resulting in lowered sensitivity in printing.

As described above, according to the present invention, the surface roughness (Root-Mean Square Deviation of the Profile) of the gloss control layer as measured according to ISO 4287/1 is controlled in the range of from 0.07 to 2.00 μm to control the glossiness of the surface on the receptive layer side of the image-receiving sheet as measured according to JIS Z8741 Method 4 in the range of from 10 to 95%.

In the prior art method, the roughness of the surface of the receptive layer has been controlled to render the image-receptive layer matte or to control the gloss of the image-receiving sheet. This control often resulted in an uneven density and a dropout in a printed image. By contrast, in the present invention, since the gloss of the surface on the receptive layer side of the image-receiving sheet is controlled by taking advantage of the gloss control layer interposed between the substrate and the receptive layer, there is no possibility that irregularities which adversely affect the image quality are created.

When the surface roughness is brought to less than 0.07 μm, the gloss is substantially equal to that in the case of a surface roughness of about 0.07 μm. When the surface roughness exceeds 2.00 μm, the irregularities influence the surface of the receptive layer, often adversely affecting the image quality.

The control of the surface roughness of the gloss control layer in the above range can be carried out by controlling coating conditions such as coating weight of an ink for the gloss control layer, rheological properties of the ink, and drying conditions.

When an appearance having the so-called matte feeling which can be provided in the case of a glossiness on the receptive layer side of less than 65% is contemplated, the coating weight of the ink for a gloss control layer is suitably 5 to 30 g/m$^2$. The viscosity of the ink is suitably 4 to 100 cps, particularly preferably 5 to 40 cps. Regarding drying conditions, a drying temperature of 40° to 100° C. is suitable. Coating of the ink for a gloss control layer under the above conditions followed by drying of the coating while creating convection within the wet coating to form cells which will be described later can result in increased surface roughness of the gloss control layer.

A cell formation mechanism is diagrammatically shown in FIGS. 1 to 4. FIG. 1 is a typical diagram showing the convection of an ink in a wet coating during drying of the wet coating, for constituting a gloss control layer, formed on a substrate. Application of heat from above or below the wet coating creates driving force by a density difference or a surface tension difference within the liquid layer, which causes convection of an ink.

Figure 2:
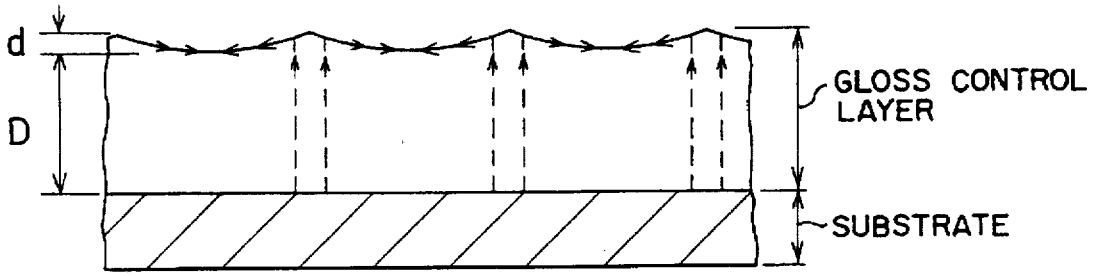
FIG. 2 is a diagram showing the advanced state of the ink shown in FIG. 1.

FIG. 2 is a typical cross-sectional view of a gloss control layer which is in an advanced state of drying. As drying proceeds, the solvent in the ink evaporates. The ink in the gloss control layer is in the form of a solution or a dispersion of a binder resin or a filler in a solvent, and the solidification thereof proceeds as shown in FIG. 2. Scattering of light in the gloss control layer is deeply related to a level difference d of surface irregularities of the gloss control layer, i.e., a distance between the highest portion and the lowest portion of irregularities, and the thickness D in a thin portion of the gloss control layer. Further, it varies depending upon the type of the filler.

In this connection, it should be noted that the coating weight of the ink per unit area is not always correlated to the thickness of the gloss control layer. Specifically, even when the coating weight of the ink is large, the thickness of the resultant gloss control layer is small if the solid content of the ink per se is low.

Figure 3:
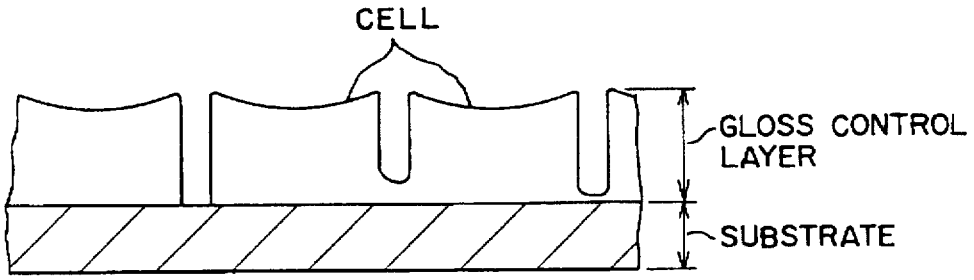
FIG. 3 is a cross-sectional view of cells formed in a gloss control layer upon the completion of drying of the ink after a further elapse of time from the state of the ink shown in FIG. 2.
Figure 4:
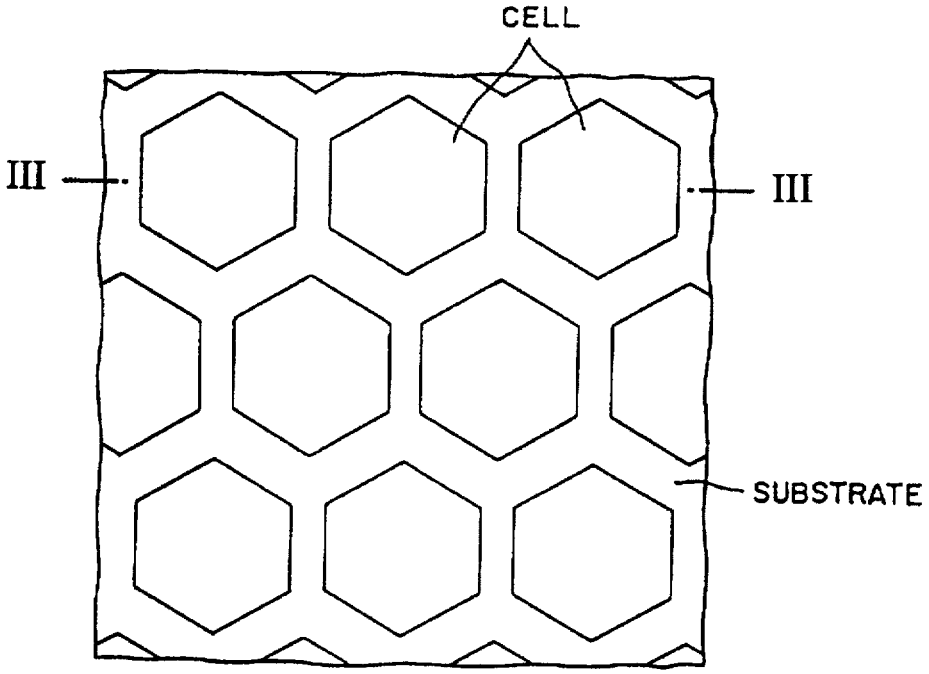
FIG. 4 is a plan view of cells shown in FIG. 3.

FIG. 3 is a cross-sectional view of a gloss control layer after drying. The surface of the gloss control layer has fine irregularities. FIG. 4 is a diagram showing this state as viewed from the top of the gloss control layer. The surface of the gloss control layer thus formed has polygonal cells. The cells are most commonly hexagonal. The formation of the cells creates irregularities, on the surface of the gloss control layer, sufficient for scattering visible light. This provides an image-receiving sheet which, like a coat paper, has an unglossy matte feeling.

The cells collectively constitute a honeycomb structure as shown in FIG. 4. Most of them are hexagonal or other polygonal shapes. FIG. 3 is a cross-sectional view taken on line III—III of FIG. 4. The cell formed by convection of a liquid in this way is known as a "Benard cell." According to the present invention, suitable surface irregularities can be created by effectively utilizing the Benard cell.

Regarding cell size distribution, cells occupying the highest proportion in the cells are such that the maximum diameter in one cell is about 10 to 150 μm. The maximum diameter in one cell is especially preferably 50 to 100 μm because suitable matte feeling can be provided.

When a high glossiness is imparted to the image-receiving sheet, the coating weight of the ink per unit area is reduced so as not to cause the above convection of the ink and the fluctuation of the surface of the coating prior to the convection.

The coating weight of the ink per unit area, when a high glossiness is imparted to the image-receiving sheet, is preferably 3 to 18 g/m$^2$ which is smaller than that when matte feeling is provided. In this case, the viscosity of the ink is preferably 40 to 150 cps which is higher than that when matte feeling is provided.

Further, when a high gloss is imparted to the image-receiving sheet, the drying temperature of the gloss control layer may be the same as that when matte feeling is provided. However, how to heat and air flow are very important. For example, when a plurality of drying zones for drying the wet coating exist, drying temperatures in these drying zones preferably have the relationship: $T1<T2<T3$ . . . wherein T1 represents the drying temperature in a drying zone immediately after coating, T2 represents the drying temperature in the next drying zone . . . The air flow is preferably not more than 0.2 dm$^3$/(sec.cm$^2$). Gentle drying in this way can reduce surface irregularities of the gloss control layer.

As described above, according to the present invention, the regulation of the surface roughness of the gloss control layer by regulating coating conditions of the ink enables the gloss of the image-receiving sheet to be controlled, the surface roughness of the gloss control layer to be increased to such an extent as will not cause any deterioration in image quality, such as an uneven density and a dropout, and the surface of the gloss control layer to be easily controlled.

The gloss control layer may be formed by any conventional coating method. Among others, gravure coating and gravure reverse coating are preferred when the above materials are used. Specifically, the materials may be dissolved and/or dispersed in a suitable solvent to prepare an ink which may be then coated on a substrate and dried to form a gloss control layer.

The gloss control layer may comprise a plurality of layers. For example, when it is desired to impart a very high opaqueness, an additional layer having a high opaqueness may be formed as a gloss control layer. In this case, this gloss control layer having a high opaqueness and the above gloss control layer are collectively referred to as "gloss control layer."

Colorant-Receptive Layer

The colorant-receptive layer is formed of a varnish composed mainly of a resin dyeable with a colorant and, added thereto, optional various additives such as a release agent. Dyeable resins usable herein include polyolefin resins such as polypropylene; halogenated resins such as polyvinyl chloride and polyvinylidene chloride; vinyl resins, such as polyvinyl acetate and polyacrlylic esters, and copolymers thereof; polyester resins such as polyethylene terephthalate and polybutylene terephthalate; polystyrene resins; polyamide resins; copolymers of olefins, such as ethylene or propylene, with other vinyl monomers; ionomers; and cellulose derivatives. They may be used alone or as a mixture of two or more. Among them, polyester resins and vinyl resins are preferred.

A release agent may be incorporated into the colorant-receptive layer in order to prevent the colorant-receptive layer from being heat-fused to a thermal transfer sheet in the course of image formation. Silicone oil, phosphoric ester plasticizers, and fluorine compounds may be used as the release agent. Among them, silicone oil is preferred. The amount of the release agent added is preferably 0.2 to 30 parts by weight based on the resin for forming the receptive layer. If necessary, a fluorescent brightening agent and other additives may be incorporated into the colorant-receptive layer.

The colorant-receptive layer may be formed by any conventional coating method such as roll coating, bar coating, gravure coating, or gravure reverse coating. The coverage is preferably 0.5 to 10 g/m$^2$ (on a solid basis).

The following examples further illustrate the present invention but are not intended to limit it. In the following examples, all "parts" are by weight unless otherwise specified.

EXAMPLE 1

Figure 6:
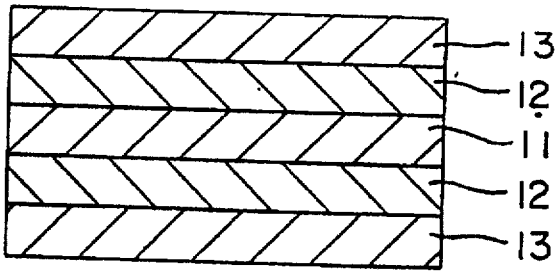
FIG. 6 is a diagram showing an embodiment of the layer constitution of a plastic film 1 shown in FIG. 5.

MW247 (35 μm) manufactured by Mobil Plastics Europe was provided as a plastic film having microvoids in its interior. This film had a construction as shown in FIG. 6, i.e., comprised a core layer 11 having microvoids in its interior, an opaque layer 12 provided on both sides of the core layer, and a surface skin layer 13, for imparting a gloss, provided on both the opaque layers 12.

A coat paper (New Top (127.9 g/m$^2$), manufactured by New Oji Paper Co., Ltd.) as a support was laminated through an adhesive onto one side of the plastic film. A 30 μm-thick layer of a polyethylene resin (Sumikathene L-5721, manufactured by Sumitomo Chemical Co., Ltd.) was formed as an anticurl layer by extrusion coating on the surface of the support remote from the plastic film. Thus, a substrate was prepared.

The substrate per se had a glossiness of 97.5%.

The following coating liquid for a gloss control layer was coated on the plastic film side of the substrate to form a gloss control layer.

| Coating liquid for gloss control layer | |
|---|---|
| Polyurethane binder (N-5199, manufactured by Nippon Polyurethane Industry Co., Ltd.) | 6.7 parts |
| Curing agent (Coronate XA-14, manufactured by Nippon Polyurethane Industry Co., Ltd.) | 0.2 part |
| Anatase type titanium oxide filler (average particle diameter 0.25 μm) | 13.3 parts |
| Methyl ethyl ketone | 30.0 parts |
| Toluene | 30.0 parts |
| Isopropyl alcohol | 10.0 parts |

The viscosity of this coating liquid, as measured with a Zahn cup No. 3, was 19 seconds. In this case, the coating weight (wet basis) of the liquid per unit area was about 6 g/m$^2$. The coverage of the gloss control layer on a dry basis was 1.3 g/m$^2$. The surface roughness of the gloss control layer thus formed was 0.10 μm.

The surface roughness of the gloss control layer was measured with a tracer type roughness meter according to ISO 4287/1. The measured area was 25 mm$^2$.

The following coating liquid for a receptive layer was coated on the gloss control layer by gravure reverse coating at a coverage on a dry basis of 4.0 g/m$^2$ to form a receptive layer, thereby preparing a thermal transfer image-receiving sheet.

| Coating liquid for receptive layer | |
|---|---|
| Vinyl chloride/vinyl acetate copolymer (Denka Vinyl #1000A, manufactured by Denki Kagaku Kogyo K. K.) | 7.2 parts |
| Vinyl chloride/styrene/acrylate copolymer (Denkalac #400A, manufactured by Denki Kagaku Kogyo K. K.) | 1.6 parts |
| Polyester (Vylon 600, manufactured by Toyobo Co., Ltd.) | 11.2 parts |
| Vinyl-modified silicone (X-62-1212, manufactured by The Shin-Etsu Chemical Co., Ltd.) | 2 parts |
| Catalyst (CAT PIR-5) | 1.0 part |
| Catalyst (CAT PL-507) | 1.0 part |
| Methyl ethyl ketone | 39 parts |
| Toluene | 39 parts |

Figure 5:
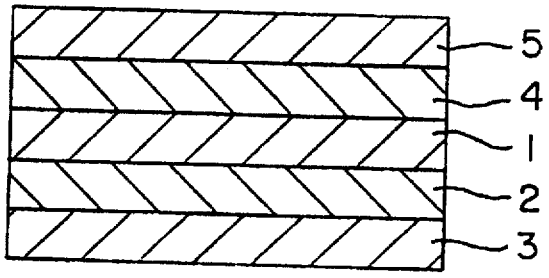
FIG. 5 is a diagram showing the layer constitution of the thermal transfer image-receiving sheet of the present invention prepared in the working examples.

The thermal transfer image-receiving sheet thus formed had a construction as shown in FIG. 5. Specifically, a plastic film 1 and a support 2 are laminated onto each other, and an anticurl layer 3 is provided on the back side of the support 2. On the other hand, a gloss control layer 4 and a receptive layer 5 are provided on the plastic film 1 side.

EXAMPLE 2

The procedure of Example 1 was repeated, except that the viscosity of the coating liquid for gloss control layer, as measured with a Zahn cup No. 3, was changed to 16 seconds.

EXAMPLE 3

The procedure of Example 1 was repeated, except that the coating weight (wet basis) of the coating liquid for gloss control layer was changed to 20 g/m$^2$.

EXAMPLE 4

The procedure of Example 3 was repeated, except that calcium carbonate (MC-T having an average particle diameter of 0.25 μm, manufactured by Maruo Calcium Co., Ltd.) was used instead of the titanium oxide.

EXAMPLE 5

The procedure of Example 1 was repeated, except that a polypropylene film having a single layer structure of a foam layer having microvoids in its interior (P4255 having a thickness of 35 μm, manufactured by Toyobo Co., Ltd.) was used as the substrate. The glossiness of the substrate was 31.5%.

EXAMPLE 6

The procedure of Example 3 was repeated, except that a polypropylene film having a single layer structure of a foam layer having microvoids in its interior (P4255 having a thickness of 35 μm, manufactured by Toyobo Co., Ltd.) was used as the plastic film in the substrate. The glossiness of the substrate was 31.5%.

EXAMPLE 7

The procedure of Example 1 was repeated, except that a polyethylene terephthalate film not containing any microvoids in its interior (S-10 having a thickness of 50 μm, manufactured by Toray Industries, Inc.) was used as the substrate. The glossiness of the substrate was 98.5%.

Comparative Example 1

The procedure of Example 1 was repeated, except that no gloss control layer was provided and the surface of the colorant-receptive layer was embossed, thereby preparing a matte image-receiving sheet.

The following measurements were carried out for the thermal transfer image-receiving sheets of the above examples and comparative examples. The results are given in Table 1.

1) Glossiness (%)

The surface glossiness of the receptive layer was measured according to JIS Z8741 Method 4.

2) Surface Roughness (μm)

The surface roughness of the gloss control layer was measured according to ISO 4287/1. For Comparative Example 1, however, the surface roughness of the receptive layer was measured.

3) Sensitivity in Printing

In order to evaluate the sensitivity in printing, a gradation test pattern was printed on the thermal image-receiving sheet under conditions of an applied voltage of 15.7 V and a printing speed of 5.5 msec/line, and the print density in the 9th gradation among 14 gradations was determined by measuring the reflection density with a Macbeth densitometer. The print density was evaluated based on the optical density 1.00. The evaluation criteria are as follows.

○: Not less than 1.10

Δ: 0.95 to 1.09

X: Not more than 0.94

4) Image Quality

The image quality was evaluated according to the following criteria:

○: None of uneven print density and dropout observed in printed image.

X: Uneven print density and/or dropout observed in printing image.

TABLE 1

| | Glossiness | Surface roughness | Image quality | Sensitivity in printing |
|---|---|---|---|---|
| Example 1 | 82.5 | 0.10 | ○ | ○ |
| Example 2 | 71.2 | 0.12 | ○ | ○ |
| Example 3 | 24.5 | 0.30 | ○ | ○ |
| Example 4 | 30.2 | 0.25 | ○ | ○ |
| Example 5 | 55.6 | 0.11 | ○ | Δ |
| Example 6 | 20.3 | 0.35 | ○ | Δ |
| Example 7 | 86.6 | 0.09 | ○ | X |
| Comparative Example 1 | 65.5 | 0.10* | X | X |

*: Surface roughness of receptive layer

What is claimed is:

1. A thermal transfer image-receiving sheet comprising: a substrate; a receptive layer; and a gloss control layer provided between the substrate and the receptive layer, the gloss control layer having a surface roughness of 0.07 to 2.00 μm as measured according to ISO 4287/1.

2. The thermal transfer image-receiving sheet according to claim 1, wherein the surface thereof on the receptive layer side thereof has a glossiness of 10 to 95% as measured according to JIS Z8741 Method 4.

3. The thermal transfer image-receiving sheet according to claim 1, wherein the gloss control layer comprises a filler and a binder resin.

4. The thermal transfer image-receiving sheet according to claim 3, wherein the filler comprises a white inorganic pigment.

5. The thermal transfer image-receiving sheet according to claim 1, wherein the substrate has a glossiness of not less than 80% as measured according to JIS Z8741 Method 4.

6. The thermal transfer image-receiving sheet according to claim 1, wherein the substrate comprises a plastic film having internal microvoids.

7. A method of controlling the gloss of a thermal transfer image-receiving sheet comprising a substrate and a receptive layer, said method comprising the steps of:

providing a substrate;

forming a gloss control layer on the substrate;

forming a receptive layer on the gloss control layer; and controlling the surface roughness of the gloss control layer in the range of 0.07 to 2.00 μm, as measured according to ISO 4287/1, thereby controlling the glossiness of the surface of the thermal transfer image-receiving sheet on the receptive layer side thereof in the range of 10–95%, as measured according to JIS Z8741 Method 4.

* * * * *